US006951224B2

(12) United States Patent
Garrett

(10) Patent No.: US 6,951,224 B2
(45) Date of Patent: Oct. 4, 2005

(54) WALKING SUPPORT HAVING SHOEHORN/GRIPPER AND MAGNET ACCESSORIES

(76) Inventor: Melvin C. Garrett, 2401 Williams Rd., Aransas Pass, TX (US) 78336

( * ) Notice: Subject to any disclaimer, the term of this patent is extended or adjusted under 35 U.S.C. 154(b) by 0 days.

(21) Appl. No.: 10/465,052

(22) Filed: Jun. 19, 2003

(65) Prior Publication Data

US 2004/0255995 A1 Dec. 23, 2004

(51) Int. Cl.[7] ..... A47G 25/82; A47F 13/06

(52) U.S. Cl. ..... 135/66; 223/119; 294/24; 294/65.5

(58) Field of Search ..... 135/66; 223/118, 223/119

(56) References Cited

U.S. PATENT DOCUMENTS

| | | | | |
|---|---|---|---|---|
| 1,347,382 A | | 7/1920 | Karro | |
| 1,905,076 A | | 4/1933 | Sciver | |
| 2,346,038 A | * | 4/1944 | Mason | 294/19.1 |
| 2,794,166 A | * | 5/1957 | Ferdon et al. | 340/321 |
| 3,591,226 A | | 7/1971 | Elmore | |
| 4,200,322 A | | 4/1980 | Smith | |
| 4,575,143 A | * | 3/1986 | Nast | 294/65.5 |
| 4,709,839 A | | 12/1987 | Tucker | |
| 4,802,702 A | * | 2/1989 | Bownds | 294/65.5 |
| 4,966,316 A | | 10/1990 | George | |
| 5,176,160 A | | 1/1993 | Osborn | |
| 5,188,555 A | * | 2/1993 | Zbegner | 446/133 |
| 5,372,363 A | * | 12/1994 | Siddle | 463/47.7 |
| 5,392,800 A | | 2/1995 | Sergi | |
| 5,472,211 A | * | 12/1995 | McCaughan | 273/401 |
| 5,509,653 A | * | 4/1996 | Parsons | 463/47.7 |
| 5,636,650 A | | 6/1997 | Kroeze | |
| 5,640,985 A | * | 6/1997 | Snyder et al. | 135/65 |
| 6,065,787 A | * | 5/2000 | Jarosch | 294/19.1 |
| 6,315,340 B1 | * | 11/2001 | Chen | 294/24 |
| 6,488,042 B2 | * | 12/2002 | Troyer | 135/65 |
| 6,550,490 B1 | * | 4/2003 | Morton et al. | 135/66 |
| 6,561,206 B1 | * | 5/2003 | Wilkinson | 135/65 |
| 6,705,654 B2 | * | 3/2004 | Slauf | 294/24 |

FOREIGN PATENT DOCUMENTS

| | | | | |
|---|---|---|---|---|
| FR | 2 578 401 | * | 9/1986 | A45C 3/00 |
| FR | 2 765 086 | * | 12/1998 | A45B 1/04 |
| GB | 2 122 077 A | | 1/1984 | |
| JP | 2001-286383 | * | 10/2001 | A47G 25/82 |
| JP | 2001-299419 | * | 10/2001 | A45B 3/00 |

* cited by examiner

*Primary Examiner*—Robert Canfield
(74) *Attorney, Agent, or Firm*—G. Turner Moller

(57) ABSTRACT

A walking stick or cane comprises a support having a foot at one end thereof and a handle at the other. A gripper device adjacent the foot includes a shoehorn assembly pivoted to the support for movement toward and away from the foot for grasping objects between the end of the foot and the shoehorn assembly. The gripper device is operated by a trigger mounted adjacent the handle and a rod generally parallel to the support. In one embodiment, the shoehorn assembly includes a shoehorn which acts to grasp an object. In another embodiment, the shoehorn assembly includes a shoehorn which does not act to grasp an object. A permanent magnet on the handle allows the user to invert the cane and pick up iron objects. Because the magnet is adjacent the handle, it does not collect floor debris during normal use.

15 Claims, 2 Drawing Sheets

WALKING SUPPORT HAVING SHOEHORN/GRIPPER AND MAGNET ACCESSORIES

This invention relates to an improved walking stick or cane having multiple capabilities thereby providing a more functional and desirable walking stick.

BACKGROUND OF THE INVENTION

Those who use a walking stick or cane often find themselves in a situation where it is necessary or desirable to perform some function at a location remote from the user's hands. For example, putting on shoes requires an unassisted user to bend over and slip a foot into the shoe, using one hand to manipulate the edge of the shoe so the foot slips inside. Shoehorns have long been known to assist putting on shoes and long handled shoehorns are known to avoid bending over. Shoehorns are also known to be incorporated in walking sticks as shown in U.S. Pat. Nos. 4,966,316 and 5,392,800. Other disclosures of combined shoehorn/gripper devices are found in U.S. Pat. Nos. 3,591,226 and 4,709,839.

Another example of a situation where a walking stick user finds it desirable to perform some function at a location remote from the user's hands is picking up objects that have fallen on the floor. Gripper devices have long been proposed to be incorporated in walking sticks as shown in U.S. Pat. Nos. 1,905,076; 4,200,322; 5,176,160; 5,392,800; 5,636,650 and 5,640,985 and UK Patent Application 2,122,077.

It has been proposed to provide magnets in walking sticks or similar devices to assist a user to pick an iron object off a floor or other remote surface as shown in U.S. Pat. Nos. 1,347,382; 3,591,226 and 5,392,800. The difficulty with permanent magnets in the foot of walking sticks is that magnetizable debris on the floor inadvertently collects on the foot during normal use and is a considerable inconvenience to remove.

SUMMARY OF THE INVENTION

In this invention, a walking stick or walking support provides a variety of functions in addition to assisting the user to walk or otherwise partially supporting the weight of a user. A shoehorn assembly is pivotally mounted adjacent the foot of the walking stick to assist the user in putting on shoes and to provide a gripping device to pick objects off a remote surface. An actuator for moving the shoehorn includes a supplementary handle or trigger adjacent the main hand support of the walking stick. A permanent magnet is provided on the handle of the walking stick so the walking stick may be inverted and pick magnetizable objects off a remote surface. Placing the magnet on the handle keeps the magnet free of debris which would be picked up off the floor during normal use of the walking stick.

It is an object of this invention to provide an improved walking stick or cane having multiple capabilities.

A further object of this invention is to provide an improved walking stick which has the capability of assisting the user to put on shoes and to grip objects distant from the user.

Another object of this invention is to provide an improved walking stick having a magnet on the handle to assist picking up magnetic objects distant from the user.

Another object of this invention is to provide a walking stick having the ability to assist the user to pick up objects from the floor either magnetically or by gripping the object.

These and other objects and advantages of this invention will become more apparent as this description proceeds, reference being made to the accompanying drawings and appended claims.

DETAILED DESCRIPTION

Figure 1:
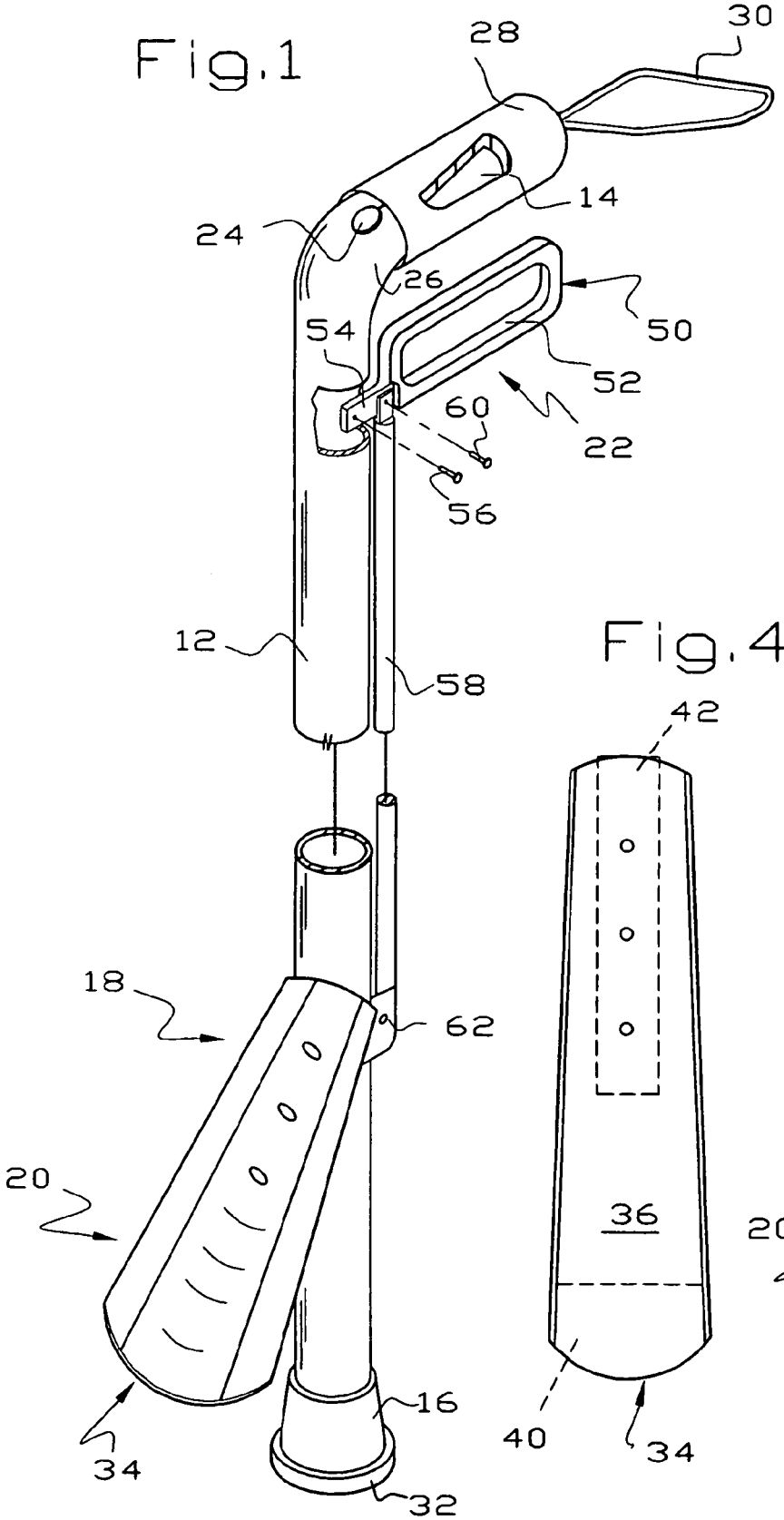
FIG. 1 is an isometric view of a walking stick or walking support of this invention, certain parts being broken away and certain parts being exploded for clarity of illustration.
Figure 4:
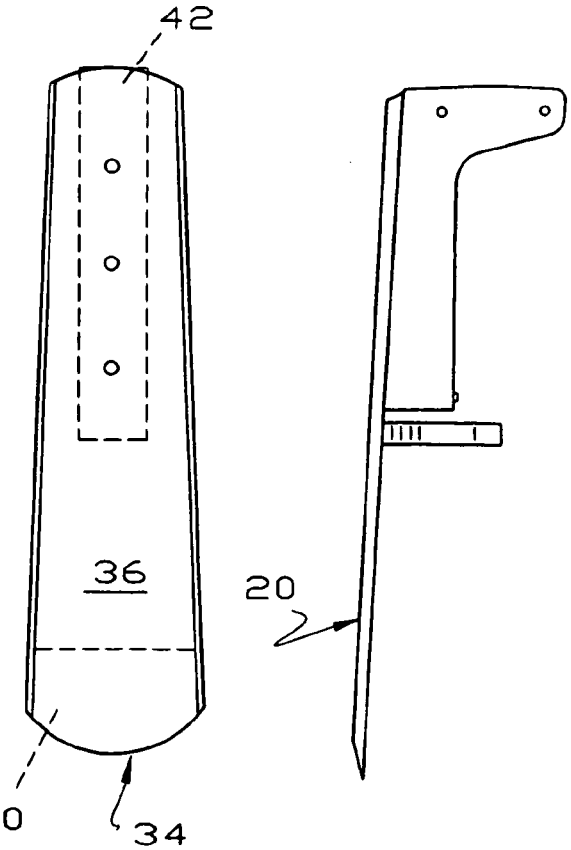
FIG. 4 is a front view of the shoehorn.

Referring to FIGS. 1–5, a walking stick walking support or cane 10 of this invention comprises, as major components, a sturdy elongate support 12 having a hand support or handle 14 at one end and a foot 16 at the other, a gripper 18 including a shoehorn assembly 20 and a mechanism 22 for moving the shoehorn assembly 20 toward and away from the foot 16, and a magnet 24 for picking up magnetizable objects.

The support 12 and handle 14 may be made of any suitably sturdy material and preferably are made from a non-corrodible metal tube. The support 12 may be made in a variety of lengths to accommodate people of different height. In the alternative, the support 12 may be of adjustable length, as explained more fully hereinafter. The handle 14 may be of any desired configuration and is illustrated as being of a conventional cane-like type, being generally perpendicular to the support 12 and connected to the support 12 by a suitable smooth bend 26. Conveniently, a resilient cover or sleeve 28 is placed over the handle 14 to provide traction. The sleeve 28 may provide a cord 30 for stowing the walking stick 10 on a peg or the like.

The foot 16 is of a conventional type and is made of hard rubber or comparable material providing traction to the floor in a conventional manner. The foot 16 preferably includes a rim 32 which cooperates with the shoehorn assembly 20 to grip objects at a remote location from the user's hands as will become more fully apparent hereinafter.

The shoehorn assembly 20 includes a shoehorn 34 made of a suitable material and in a suitable shape. The shoehorn 34 preferably includes a concave side or face 36 and a convex side or face 38. The lower end of the shoehorn 34 is sufficiently thin to pass between a user's foot and shoe when used as a shoehorn. The lower end of the shoehorn 34 is typically about 1/16" thick although it may be of any suitable thickness. The convex face 38 faces toward the support 12 and cooperates with the foot 16 to grip objects and thus has a double function. When used as a shoehorn, the convex face 38 abuts the back or heel of the shoe. The shoehorn 34 may be of plastic and of a conventional shape where the opposite sides or faces 36, 38 are more or less parallel. In the alternative, the shoehorn 34 may be of metal. A simple manner in which to make the shoehorn 34 is out of aluminum sheet which is creased down the middle to provide a broadly V-shaped structure, which, in accordance with this invention, is concave. It will be seen that the assembly 20 provides an arm comprising the shoehorn 34.

To provide improved traction, a friction enhancing material 40 may be provided on the convex side 38. The material 40 may be of any suitable type, such as a latex coating bonded to the face 38, part of a hook-and-loop fastener adhesively applied to the face 38 and the like.

The shoehorn assembly 20 also includes a lever or arm 42 secured to the shoehorn 34 in any suitable manner, as by the provision of mechanical fasteners, adhesives or the like. In the alternative, the shoehorn 34 and lever 42 may be made in one piece by injection molding a plastic resin. The lever 42 is pivoted to the support 12 in any suitable manner, as by a pop rivet or pin 44. The assembly 20 is accordingly movable between a position spaced from the foot 16 providing a gap where an object can be placed and a position near the foot 16 where the object is grasped between the shoehorn 34 and the foot 16, as suggested by a comparison of FIGS. 2 and 3. As shown by a comparison of FIGS. 2 and 3, the tubular support 12 includes a pair of slots 46, 48 which are suitably sized and spaced to receive and accommodate movement of the lever 42.

The actuation mechanism 22 is designed to operate the shoehorn assembly 20 from a location adjacent the handle 14 in a manner that is easily accomplished by the user. To this end, the mechanism 22 includes a supplementary handle or trigger 50 of any suitable configuration. As illustrated, the trigger 50 includes a handhold slot 52 which conveniently allows the user to place the palm of the support hand on top of the handle 14 and the fingers of the support hand through the slot 52. The trigger includes an end 54 extending into a slot in the support 12 and pivoted to the support 12 by a pop rivet or pin 56. A rod or other tensile element 58 connects the trigger 50 to the lever 42 and is pivoted thereto by pop rivets or pins 60, 62. In the event the support 12 is made of adjustable length, as by providing telescoping sections, the rod 58 must also be adjustable.

It may be desirable to provide a clip 64 for temporarily securing the shoehorn assembly 20 to the support 12 thereby positioning the shoehorn 34 immediately adjacent the support 12 without effort by the user. As shown best in FIG. 5, the clip 64 is a conventional plastic C-shaped clip of a size to expand over the diameter of the support 12. Clips of this type are conventionally used to connect lightweight articles to electrical conduit and are well known in the building trade. The clip 64 is easily detached from the support 12 by pushing an edge thereof away from the support 12 or by pushing the trigger 50 away from the handle 14.

The magnet 24 is a conventional permanent magnet of suitable strength and is located in an operative position on the handle 14, i.e. on the handle 14 or on the bend 26. By an operative position, it is meant that the magnet 24 is located on the outer side of the handle or bend 26 so it will juxtapose the floor when the walking stick 10 is inverted, either upright or at a suitable angle. As shown best in FIG. 1, the magnet 24 faces in a direction generally parallel to the support 12. It will be apparent that placing the magnet 24 underneath the handle 14, i.e. between the handle 14 and the trigger 50 is not in an operative position. It will be recognized that the magnet 24 may be off the centerline of the handle 14 and, in compensation, the support 12 may be tilted to place the magnet 24 against the object to be picked up. By placing the magnet 24 on the handle 14, the magnet 24 does not accumulate magnetizable debris from the floor during normal use of the walking stick 10.

Use of the walking stick or cane 10 is now apparent. In normal use where the stick 10 is used to support part of the weight of the user, the user simply grasps the handle 14 and leans on the stick 10 in a normal manner. The clip 64 may be used to secure the shoehorn assembly 20 in its closed position if desired. When the user wants to put on a shoe, the user simply inserts the bottom end of the shoehorn 34 in the back of the shoe. If it is necessary to stabilize the shoe, the user grips the back of the shoe between the back face 38 of the shoehorn 34 and the foot 16. The user sticks the toe into the shoe, places the heel on the shoehorn and adds weight to the foot and the shoehorn 34 assists the user in a conventional manner.

Figure 2:
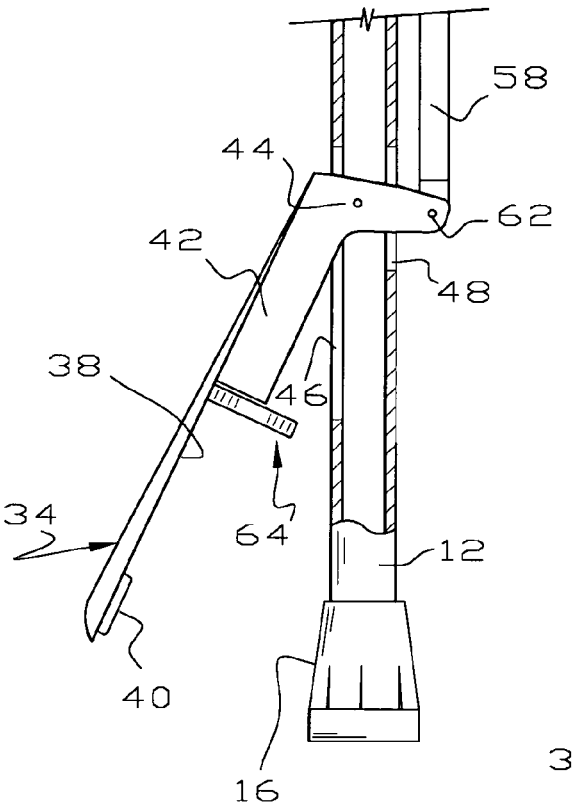
FIG. 2 is an enlarged view of the foot end of the walking stick of FIG. 1, illustrating an open position of the shoehorn/gripper relative to the foot.
Figure 3:
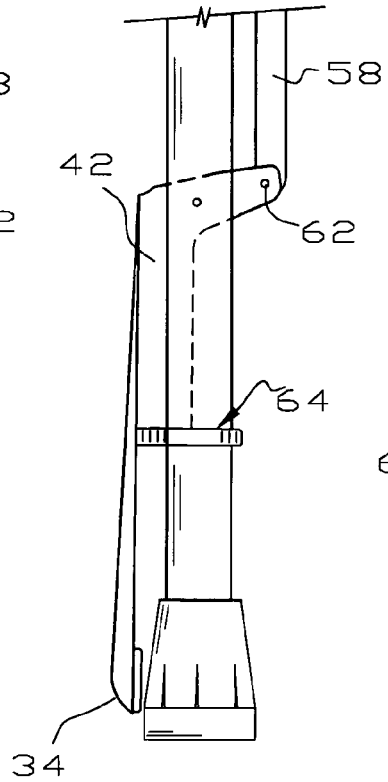
FIG. 3 is a view similar to FIG. 2, illustrating the shoehorn/gripper retracted into a position adjacent the walking stick.
Figure 5:
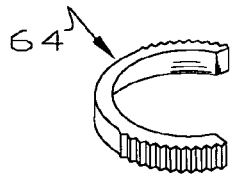
FIG. 5 is a top view of a clip used to secure the shoehorn temporarily to the walking stick.

If the user wants to pick an object off the floor, the trigger 50 is manipulated to open the shoehorn assembly 20 and place the object between the bottom of the shoehorn 34 and the foot 16 as suggested by FIG. 2. The trigger 50 is then squeezed toward the handle 14 and the shoehorn assembly 20 closes against the object. The user can then raise the walking stick 10 and retrieve the object from the bottom thereof.

If the user wants to pick a magnetizable object off the floor or other remote surface without using the gripper 18, the user grasps the support 12, turns the walking stick 10 upside down and places the magnet 24 against the object.

Figure 6:
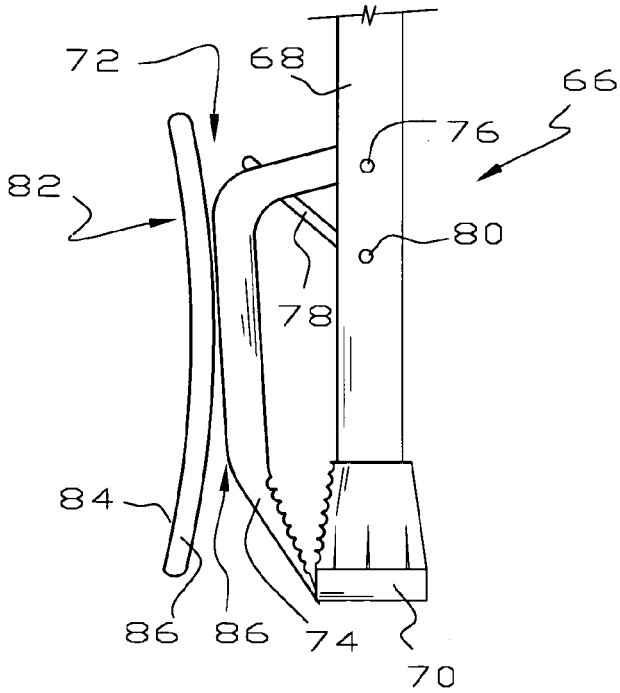
FIG. 6 is a side view, similar to FIG. 3, of another embodiment of this invention.

Referring to FIG. 6, the lower end of another embodiment of this invention is illustrated. A walking stick or cane 66 includes an elongate tubular support 68 having a foot 70 for supporting weight of the user in a conventional manner. A gripper 72 includes an arm 74 pivoted by a pin 76 to the support 68 so it cooperates with the foot 70 to grasp articles in a conventional manner. The gripper 72 is manipulated by a mechanism (not shown) inside the tubular support 68 which includes a wire or other tensile element 78 attached to the arm 74, extending around a roller or pulley (not shown) inside the tubular support 68 and connected thereto by a pin or bushing 80.

The gripper 72 also includes a shoehorn 82 fixed to the arm 74 in any suitable manner. The shoehorn 82 provides a concave face or side 84 facing away from the support 68 and a convex side or face 86 facing toward the support 68. The gripper 72 and shoehorn 82 may be manipulated to assist a user in putting on shoes in much the same manner as described above. The disadvantages of the walking stick 66 are that it is somewhat bulkier and the gripper 72 cannot be used to stabilize the shoe when using the shoehorn. The walking stick 66 does, however, work acceptably considering that conventional shoehorns do not stabilize a shoe either.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A walking support for supporting weight of a user, for grasping an object on a remote surface and for assisting the user in putting on shoes, comprising an elongate support having a foot at a first end and a foot at a second end for supporting weight of a user, and a gripper including a shoehorn assembly mounted for movement toward and away from a lower end of the support for grasping an object between the shoehorn assembly and a lower end of the elongate support and an actuator for manipulating the shoehorn assembly, the shoehorn assembly including a shoehorn having a lower end sufficiently thin to pass between a user's foot and shoe and acting as a shoehorn whereby the user may use the gripper to grasp an object on a remote surface and use the shoehorn to assist the user in putting on shoes.

2. The walking support of claim 1 wherein the elongate support provides a hand support spaced from the foot and comprising a handle extending away from a first side of the elongate support, the shoehorn being on a different side of the elongate support.

3. The walking support of claim 2 wherein the shoehorn and handle are on opposite sides of the elongate support.

4. The walking support of claim 1 wherein the elongate support provides a handle and the actuator includes a trigger positioned adjacent the handle for being gripped by the user and a connector extending between the trigger and the shoehorn assembly for moving the shoehorn assembly toward and away from the support in response to movement of the trigger.

5. The walking support of claim 1 wherein the shoehorn comprises a concave side facing away from the lower end of the support and a second convex side of the shoehorn generally parallel to the concave side.

6. The walking support of claim 1 wherein the shoehorn assembly comprises an arm cooperating with the foot for grasping objects therebetween and the arm is between the shoehorn and the foot whereby the shoehorn does not grasp an object.

7. The walking support of claim 6 wherein the shoehorn is mounted on the arm.

8. The walking support of claim 1 wherein the shoehorn comprises a first concave side facing away from the elongate support acting as a guide for the user's foot and a second side facing toward the support, the second side cooperating with the foot for grasping objects therebetween whereby the shoehorn cooperates with the foot for grasping an object.

9. The walking support of claim 8 wherein the second side of the shoehorn is convex.

10. The walking support of claim 8 wherein the second side is generally parallel to the first side.

11. The walking support of claim 1 wherein the elongate support provides a member spaced from the foot and further comprising a permanent magnet in an operative position on the member whereby the user can invert the walking support and magnetically pick up magnetizable objects on a remote surface thereby keeping the magnet free of floor debris during normal use of the walking support.

12. The method of using a walking support having multiple capabilities and comprising an elongate support having a body support at a first end and a foot at a second end for supporting weight of a user, and a gripper including a shoehorn assembly mounted for movement toward and away from a lower end of the support for grasping an object between the shoehorn assembly and a lower end of the elongate support and an actuator for manipulating the shoehorn assembly, the shoehorn assembly including a shoehorn having a lower end sufficiently thin to pass between a user's foot and shoe and acting as a shoehorn whereby the user may use the gripper to grasp an object on a remote surface and use the shoehorn to assist the user in putting on shoes, the method comprising supporting weight of the user on the body support;

grasping an object between the shoehorn assembly and the foot; and guiding the user's foot into a shoe with the shoehorn.

13. The method of claim 12 wherein the shoehorn assembly comprises an arm cooperating with the foot for grasping objects therebetween and the arm is between the shoehorn and the foot, and wherein the grasping step comprises grasping the object between the arm and the foot, and wherein the grasping step comprises grasping an object between the arm and the foot whereby the shoehorn does not grasp an object.

14. The method of claim 12 wherein the shoehorn comprises a first concave side facing away from the support acting as a guide for the user's foot and a second side facing toward the support, the second side cooperating with the foot for grasping objects therebetween, and wherein the grasping step comprises grasping an object between the shoehorn and the foot.

15. The method of claim 12 wherein the walking support further comprises a permanent magnet in an operative position on the body support, and the method further comprises inverting the walking support and magnetically picking up a magnetizable object on a remote surface thereby keeping the magnet free of floor debris during normal use of the walking support.

* * * * *